United States Patent [19]

Stocke

[11] 4,163,273

[45] Jul. 31, 1979

[54] CORONA DISCHARGE APPARATUS AND METHOD HAVING MEANS FOR IMPROVED MOUNTING OF CORONA DISCHARGE WIRE

[75] Inventor: John P. Stocke, Palatine, Ill.

[73] Assignee: AM International, Inc., Los Angeles, Calif.

[21] Appl. No.: 820,415

[22] Filed: Aug. 1, 1977

[51] Int. Cl.[2] ..... F24F 3/12

[52] U.S. Cl. ..... 361/229; 55/147; 55/151; 361/231

[58] Field of Search ..... 55/146, 147, 148, 150, 55/151; 361/212, 214, 225, 229, 230, 231

[56] References Cited

U.S. PATENT DOCUMENTS

| | | | |
|---|---|---|---|
| 3,483,670 | 12/1969 | Quintilian | 55/147 |
| 3,943,418 | 3/1976 | Quang | 55/147 |
| 3,997,304 | 12/1976 | Carr | 361/229 |
| 4,064,548 | 12/1977 | Best et al. | 361/231 |

*Primary Examiner*—Gerald Goldberg

*Attorney, Agent, or Firm*—George Jameson; Michael A. Kondzella; Russell L. Root

[57] ABSTRACT

There is provided a corona filament assembly which is characterized by parallel rails each having a plurality of binding posts secured thereto. Each post is formed of a button about which the filament turns and having a lip spaced from the rail and an O-ring gripping element compressibly coacting between the rail and the lip to hold the filament. The filament is wound about the binding posts in a serpentine manner and tightly retained by the O-ring.

7 Claims, 2 Drawing Figures

CORONA DISCHARGE APPARATUS AND METHOD HAVING MEANS FOR IMPROVED MOUNTING OF CORONA DISCHARGE WIRE

BACKGROUND OF THE INVENTION AND PRIOR ART

This invention relates to means for attaching a corona filament wire to a terminal strip easily and without the use of fasteners.

Corona discharge devices are frequently used in electrostatic copying apparatus. In such apparatus, a sheet of copy paper is provided with a coating of a photoconductive insulating material and passed through a corona charging device which imparts a substantially uniform electrostatic charge to the coated side of the paper. The paper is then subjected to a light pattern image or indicia on the original document whereupon the electrostatic charge is dissipated in the light non-image areas but is retained in the darker image areas after which the sheet is subjected to an application of electrostatically attractable toner particles to develop the latent image left on the paper.

Substantially the same principles are applied in the field of reusable electrostatic copying in which the photoconductive insulating material is a coating on a drum or a belt which is grounded and on which the latent electrostatic image is formed and developed. This image is then transferred to ordinary paper, and the drum or belt cleaned and reused in the same manner to make successive copies.

In either of the foregoing processes, it is necessary to electrostatically charge the photoconductor prior to exposing it to the light pattern. This is done by means of corona discharge from one or more very thin filaments or wires on the order of from 2 to 3 mils in diameter which are stretched across the path of the photoconductor and to which is applied a negative electric potential of the order of 6,000 volts.

Corona filaments are also used in various other aspects of copying such as the application of a bias voltage during developing, transfer of the image or cleaning of the photoconductor.

A principal problem with the corona discharge apparatus is the accumulation of dirt and other foreign matter on the corona wire. It is known that accumulations of dirt, such for example as paper dust, dry toner particles, etc. prevent a corona effect from being achieved along the portion of the wire which is covered by the foreign matter. Thicknesses of as little of 2 mils of foreign matter on the corona discharge wire have been found to be sufficient to prevent the corona from being produced along that portion of the wire. This results in a nonuniform electrostatic discharge on the photoconductor, and therefore, in the case of a charging corona, for example, any image projected on this portion of the photoconductor is not reproduced since no toner particles will adhere to a noncharged area of the photoconductor.

While it is possible initially to clean dirty corona wires manually with a soft brush, once the deposits have been allowed to collect and congeal, this is not very practical since the wires are delicate and easily broken if anything more than the lightest force is applied.

The most effective way of handling the problem of a corona discharge wire to which foreign deposits have become firmly attached is to replace the wire entirely. The present invention provides an improved system and apparatus for facilitating replacement of the corona discharge wire. Reference may be had to the prior patents to Martin U.S. Pat. No. 3,499,143 and to Salger U.S. Pat. No. 3,566,223 for prior art teachings directed to the replacement of corona discharge wires.

The present invention provides an improved filament assembly wherein the corona discharge filament can be put in place merely by wrapping it about a plurality of filament binding posts so constructed as to automatically grasp and frictionally retain the corona wire at each turning point, and to enable the imposition of suitable tension on the wire without detracting from the ready removability of the wire in the event of replacement.

BRIEF STATEMENT OF THE INVENTION

Briefly stated, the present invention is in a corona discharge assembly having support means to which binding posts are affixed. The binding posts each have a retaining member cooperating with a resilient pressure device so that a length of corona discharge wire can be strung between two posts by merely entering a portion of the wire, by a lateral movement, between the retaining members and the resilient pressure device, exerting a slight pull in the wire and taking a certain degree of wrap around the post. In the preferred arrangement the support takes the form of a frame having parallel side terminal strips. Each of the terminal strips is provided with a plurality of longitudinally spaced binding posts, preferably in staggered relationship with respect to the opposing binding posts on the opposite terminal strip and about which the corona discharge wire is wound in a serpentine manner. The binding posts are each composed of a button member which is secured to the strip, preferably by swaging and characterized by a peripheral lip or rim spaced from the strip. The lip and the surface of the terminal strip define a peripheral recess or groove in which there is placed a resilient O-ring member which compressibly coacts between the terminal strip and the lip to hold the corona discharge filament.

BRIEF DESCRIPTION OF THE DRAWINGS

The present invention will be better understood by having reference to the annexed drawings wherein.

DETAILED DESCRIPTION OF THE DRAWINGS

Figure 1:
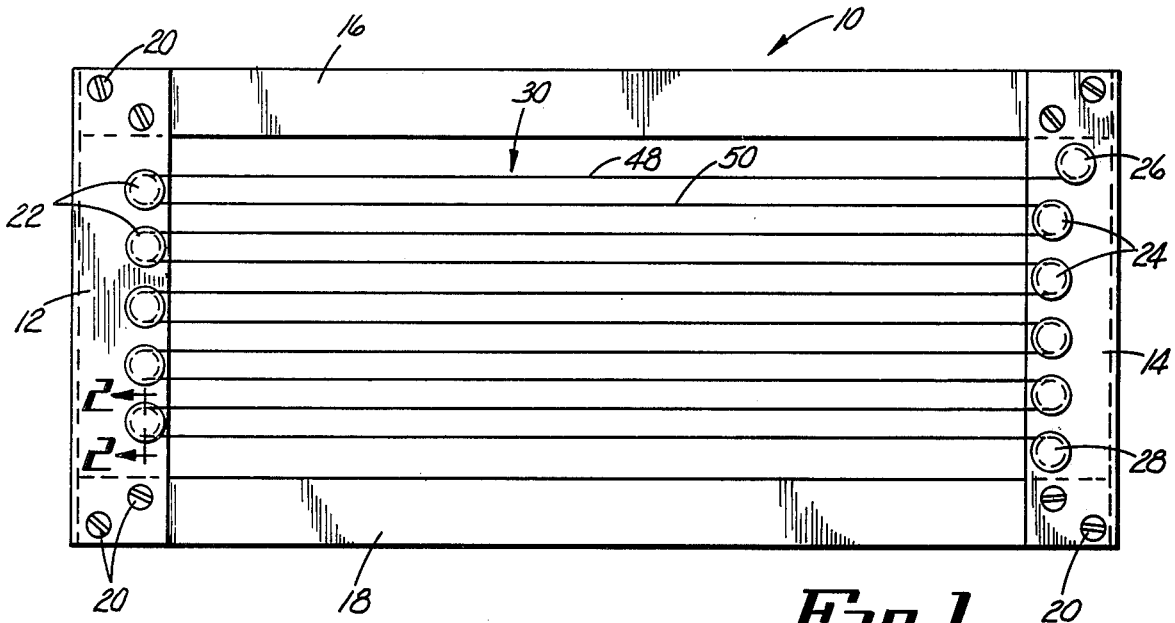
FIG. 1 is a plan view of a corona filament assembly showing a corona wire wound in a serpentine manner about a plurality of binding posts disposed along parallel terminal strips.

Referring now more particularly to FIG. 1, there is here shown a corona discharge rack assembly 10 adapted for use in an electrostatic copying machine. This assembly is composed of support means in the form of a pair of parallel terminal strips 12 and 14, and side rails 16 and 18 forming a frame, said terminal strips and rails being fastened together by suitable means such as screws 20.

The terminal strip 12 is provided with a plurality of longitudinally spaced binding posts 22. In like manner, the terminal strip 14 is provided with a plurality of binding posts 24 in longitudinal array, and spaced the same distance apart as the binding posts 22, but in staggered relation with the opposite binding posts 22. The strip 14 is also provided with a first terminal binding post 26 and a final terminal binding post 28. A corona discharge filament wire 30 of conventional material, e.g., tungsten, and of conventional diameter, e.g., 2 mils, is wound in a serpentine manner beginning at the binding post 26 and coursing alternately around the binding posts 22 and 24, and ending at the terminal binding post 28. The tungsten wire 30 makes a 180° turn about the binding posts 22 and 24, respectively. At the terminal binding post 26 and 28, the wire is wound preferably to the extent of 360°.

Figure 2:
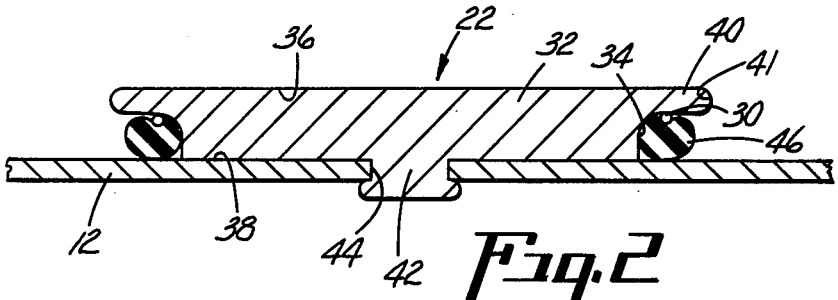
FIG. 2 is a cross sectional view on an enlarged scale of a single binding post as it appears in the plane indicated by the line 2—2 of FIG. 1.

The details of construction of the binding posts 22 and 24 are best shown in FIG. 2 which is a cross sectional view on an enlarged scale of a binding post 22 as it appears in the plane indicated by the line 2—2 in FIG. 1. The binding posts 22 in a preferred embodiment are identical with the binding posts 24, 26 and 28.

These elements in their preferred form are axially thin metallic members, preferably circular in plan as shown in FIG. 1. As shown in FIG. 2, the binding post 22 is a relatively thin metallic disc or plate 32 having preferably parallel distal surface 36 and base surface 38. The distal surface 36 has a larger diameter than the base surface 38, and hence there is an annular recess or peripheral groove 34, and an overhanging peripheral flange or lip 40 to define the outer periphery of the disc. There is also provided a reduced center post portion 42 adapted to extend through an aperture 44 in the terminal strip 12, preferably to an extent sufficient to project beyond the opposite surface of the strip 12. The binding post 22 at its base is permanently attached to the terminal strip 12 by swaging or peening over the outer axial end of the post 42 in the manner shown in FIG. 2 to secure the post 22 to the terminal strip 12. However, any suitable alternate means for attaching the binding posts 22, 24, 26, and 28 to the respective terminal strips 12 and 14 may be used including welding, machine screws, etc.

While the groove or recess 34 is most conveniently and economically formed between the flange 40 and the terminal strip 12, it will be understood that any similarly configured recess, however produced, will serve equally well for the purposes of this invention.

In the groove 34, there is provided a resilient band, preferably an O-ring 46 formed of any suitable elastomeric material such as Neoprene. The cross sectional diameter of the O-ring 46 in the free state is slightly greater than the axial width of the groove 34 such that when the O-ring 46 is assembled with the terminal binding post 22 as shown in FIG. 2, it is trapped between the lip 40 and the terminal strip 12 and compressed therebetween. The terminal post 22 is sized such that the maximum lip diameter extends beyond the outside diameter of the O-ring. A tungsten wire 30 is wedged or trapped between the lip 40 and the O-ring 46 as shown in FIG. 2. Alternatively, the wire 30 may be wedged between the O-ring 46 and the terminal strip 12.

In a typical embodiment, the O-ring is conveniently provided with a diameter of 1/16 of an inch, and is desirably characterized by excellent abrasion, tear and ozone resistance. It is in order to obtain proper holding grip without requiring excessive filament tension during placement of the corona discharge wire that the axial width of the groove formed between the lip or rim 40 and the terminal strip 12 is about 1/64" less than the normal cross sectional diameter (1/16") of the O-ring with an operative tolerance of about = 0.005". Thus, the groove 34 is designed to effect an axial compression of the O-ring 46 of about 0.01 to 0.02 inch.

The configuration of the lip 40, particularly the radius 41 at the under surface of the lip edge, cooperates with the cross-sectional shape of the O-ring to provide a notch into which the corona wire can readily find its way. Also the overall diameter of the lip is such as to present an overhang which acts as a lead in surface against which the wire can be drawn to guide it into the notch.

In attaching the tungsten wire 30 to the frame 10 as shown in FIG. 1, the wire is preferably wound around the terminal binding post 26 a full 360° and locked in place by the compressive effect of the O-ring 46 against the wall of the groove 34, the lip 40 and the terminal strip 14. The wire is then extended for a first reach 48 to the binding post 22 and turned thereabout a total of 180° and again wedged between the resilient O-ring 46 and a lip 40, or the terminal strip 12. The wire 30 is then extended for a second reach 50 to the opposite staggered terminal post 24 where it is again turned through 180° and frictionally retained between the O-ring 46 and the lip 40 or the terminal strip 12. Stringing of the tungsten wire 30 in this serpentine manner is continued until the array of binding posts on the terminal strips 12 and have been coursed in the manner indicated and the terminal binding post 28 has been reached. At this point, the tungsten wire is again wound through 360° and tensioned sufficiently to overcome the resilience of the O-ring 46 for locking into position. The wire 30 may then be cut from a supply reel. The corona discharge apparatus is now in condition for insertion in the electrostatic copying machine in a known manner.

Suitable means are provided for making an electrical connection between the corona filament and a source of power. In the present instance this is most easily done by providing a power connection either to the support or to one of the binding posts. In case the electrical connection is to the support and the filament is attached as shown in FIG. 2, then both the support and binding posts must be of electrically conductive material. In the FIG. 2 arrangement, if connection were directly to one of the binding posts, only the binding post would need to be conductive. On the other hand, if the filament were introduced between the O-ring and the support, then only the support would need to be conductive.

The present device is characterized in that it eliminates the need for fasteners to hold the tungsten wire and hence no tools are required for assembly of the wire to the frame. This structure is readily adapted to automatic machinery for applying the wire 30 to the frame 10. Each strand of wire forming the reaches 48 and 50 etc., for example, may be tensioned separately. Assembly work is greatly facilitated, and replacement of the filament wire 30 is quite easy and takes considerably less time than heretofore. The 2 mil diameter tungsten wire is very brittle and breaks easily if kinked or otherwise mishandled. Should it happen that the filament 30 is broken during assembly, it can be tied off at the terminal post immediately preceding the break and continued from that point without affecting the corona performance. Without apparatus of the type provided herewith, the restringing process would have had to be terminated and restarted at the beginning.

While the description has dealt primarily with a corona device using plural parallel wires, it will be understood that the invention is equally applicable in situations where a single corona wire is supported between two binding posts.

What is claimed is:

1. A corona discharge apparatus comprising: a support means, a plurality of binding posts mounted on said support means, each of said binding posts being so configured as to provide a peripheral recess, a resilient O-ring compressively retained in said recess, and a corona discharge wire extending between the binding posts and anchored thereto by being frictionally gripped between said O-ring and the surface of said recess.

2. A corona discharge apparatus comprising a frame including a pair of spaced terminal strips, a plurality of binding posts on each of said terminal strips, each of said binding posts comprising a plate secured to said terminal strip and having a lip projecting from a distal portion thereof and defining with said terminal strip a peripheral recess, a resilient band compressively retained in said recess, and a corona discharge wire extending between said binding posts and anchored thereto between said band and the adjacent surface of one of said lip and said terminal strip.

3. A corona discharge apparatus comprising a rectangular frame including a pair of parallel terminal strips as marginal sides of said frame, each of said terminal strips having secured thereto a longitudinally extending array of binding posts, each of said binding posts comprising a relatively thin disc having a circumferential flange spaced from said terminal strip and defining with said terminal strip a circumferential groove, a resilient O-ring disposed in said circumferential groove, said O-ring having a cross-sectional diameter slightly greater than the axial width of said groove whereby said O-ring is compressively retained in said groove, a tungsten corona discharge wire serpentinely extending between the binding posts on opposite ones of said terminal strips to define a plurality of parallel corona discharge reaches across said frame, said wire turning 180° about each of said binding posts in alternating succession and being retained between a side of said groove and said O-ring, said discs each including an axially extending post and said terminal strips each including a plurality of apertures in longitudinal array each dimensioned to receive the axially extending post of one of said discs, means coacting between each terminal strip and the discs associated therewith to secure said discs to said terminal strips, respectively.

4. A corona discharge apparatus in accordance with claim 3 wherein terminal binding posts are provided for the free ends of the corona discharge wire and the wire is wrapped 360° about each of said terminal binding posts.

5. A method for forming a corona wire discharge apparatus comprising the steps of providing a support carrying a pair of spaced binding posts, each binding post being shaped to define a peripheral recess, providing a resilient band for each binding post compressively retained in said recess, stringing a corona wire between said binding posts by laterally forcing the wire between the compressed resilient band and the adjacent surface of the recess while turning at least 180° around said post, whereby the wire is tightly frictionally retained about the binding posts.

6. A method for forming a corona wire discharge apparatus for an electrostatic copying device and having a plurality of wire reaches comprising the steps of providing a frame having parallel terminal strips held in spaced relation, and each terminal strip being provided with an array of binding posts, each binding post comprising a plate having a lip projecting in spaced relation to the terminal strip to define a peripheral groove, and a resilient band compressively retained in said groove, serpentinely stringing said wire back and forth between said terminal strips and around said binding posts by forcing the wire between the compressed resilient band and the adjacent groove surface while turning at least 180° around said post whereby the wire is tightly frictionally retained about opposite binding posts on opposite terminal strips until a plurality of wire reaches is obtained traversing the space between said terminal strips.

7. A method in accordance with claim 6 wherein the beginning of the wire is wound 360° about the first binding post and 360° about the final binding post.

* * * * *